US008955247B2

(12) United States Patent
Sargent

(10) Patent No.: US 8,955,247 B2
(45) Date of Patent: Feb. 17, 2015

(54) PORTABLE SUPPORT MOUNT

(71) Applicant: Wyatt Sargent, Henefer, UT (US)

(72) Inventor: Wyatt Sargent, Henefer, UT (US)

( * ) Notice: Subject to any disclaimer, the term of this patent is extended or adjusted under 35 U.S.C. 154(b) by 0 days.

(21) Appl. No.: 13/938,411

(22) Filed: Jul. 10, 2013

(65) Prior Publication Data

US 2014/0013645 A1 Jan. 16, 2014

Related U.S. Application Data

(60) Provisional application No. 61/669,788, filed on Jul. 10, 2012.

(51) Int. Cl.

| | |
|---|---|
| ***F41A 23/02*** | (2006.01) |
| ***F41A 23/10*** | (2006.01) |
| ***F16M 11/00*** | (2006.01) |
| ***F41A 23/06*** | (2006.01) |

(52) U.S. Cl.

CPC ..... *F41A 23/02* (2013.01); *F41A 23/06* (2013.01); *F41A 23/10* (2013.01)

USPC ..... 42/94; 248/165; 248/188

(58) Field of Classification Search

CPC ..... F41A 23/02–23/14

USPC ..... 42/94; 89/37.04; 248/83, 85, 87, 164, 248/165, 188, 432

See application file for complete search history.

(56) References Cited

U.S. PATENT DOCUMENTS

| | | | | |
|---|---|---|---|---|
| 203,184 | A * | 4/1878 | Müller | 42/94 |
| 2,668,682 | A * | 2/1954 | Dalton | 248/169 |
| 3,633,859 | A * | 1/1972 | Vosbikian | 248/97 |
| 3,863,376 | A * | 2/1975 | Dalmaso | 42/94 |
| 4,750,414 | A * | 6/1988 | Dohrs | 99/419 |
| 5,081,783 | A | 1/1992 | Jarvis | |
| 5,406,732 | A * | 4/1995 | Peterson | 42/94 |
| 5,507,111 | A * | 4/1996 | Stinson et al. | 42/94 |
| 5,930,932 | A * | 8/1999 | Peterson | 42/94 |
| 5,930,933 | A * | 8/1999 | Schleicher | 42/94 |
| 6,058,641 | A | 5/2000 | Vecqueray | |
| 6,086,027 | A * | 7/2000 | Klimbacher | 248/166 |
| 6,305,117 | B1 | 10/2001 | Hales, Sr. | |
| 6,322,026 | B1 * | 11/2001 | Ju | 248/175 |
| 6,889,465 | B1 * | 5/2005 | Holmes | 42/94 |
| 7,571,563 | B2 * | 8/2009 | Peterson | 42/94 |
| 8,146,283 | B2 | 4/2012 | Genes et al. | |
| 8,196,504 | B2 | 6/2012 | Keng | |
| 8,297,565 | B2 | 10/2012 | McLinda | |
| 2002/0078617 | A1 * | 6/2002 | Percival | 42/94 |
| 2007/0000852 | A1 * | 1/2007 | Wajchert | 211/64 |
| 2007/0079541 | A1 * | 4/2007 | Peterson | 42/94 |
| 2007/0094911 | A1 * | 5/2007 | Rush et al. | 42/85 |
| 2010/0236126 | A1 * | 9/2010 | Johnson | 42/94 |
| 2012/0018597 | A1 * | 1/2012 | Cyr | 248/165 |

* cited by examiner

*Primary Examiner* — Bret Hayes

(74) *Attorney, Agent, or Firm* — Black, McCuskey, Souers & Arbaugh, LPA

(57) ABSTRACT

Described in an example embodiment herein is a portable support mount that can be employed as a firearms rest or as a mount for any other suitable device. The portable support mount comprises a first pair of poles intersecting to form a first rest while in a first configuration and a second pair of poles having first ends coupled with the first pair of legs. The opposite ends of the second pair of poles intersect to form a second rest while in the first configuration.

12 Claims, 5 Drawing Sheets

PORTABLE SUPPORT MOUNT

CROSS-REFERENCE TO RELATED APPLICATIONS

This application claims the benefit of priority of U.S. Provisional Application No. 61/669,788 filed Jul. 10, 2012.

TECHNICAL FIELD

The present disclosure relates generally to a support mount for supporting a device that can be used, for example, as a firearm rest for stabilizing a firearm such as a long barreled gun, rifle, and/or shotgun in a shooting position.

BACKGROUND

Support mounts are employed as rifle rests to enable users to aim and fire with better control and substantially improved accuracy. Support mounts come in a wide variety of designs such as tripods, bipods, and monopods.

BRIEF DESCRIPTION OF THE DRAWINGS

The accompanying drawings incorporated herein and forming a part of the specification illustrate the examples embodiments.

OVERVIEW OF EXAMPLE EMBODIMENTS

Figure 1:
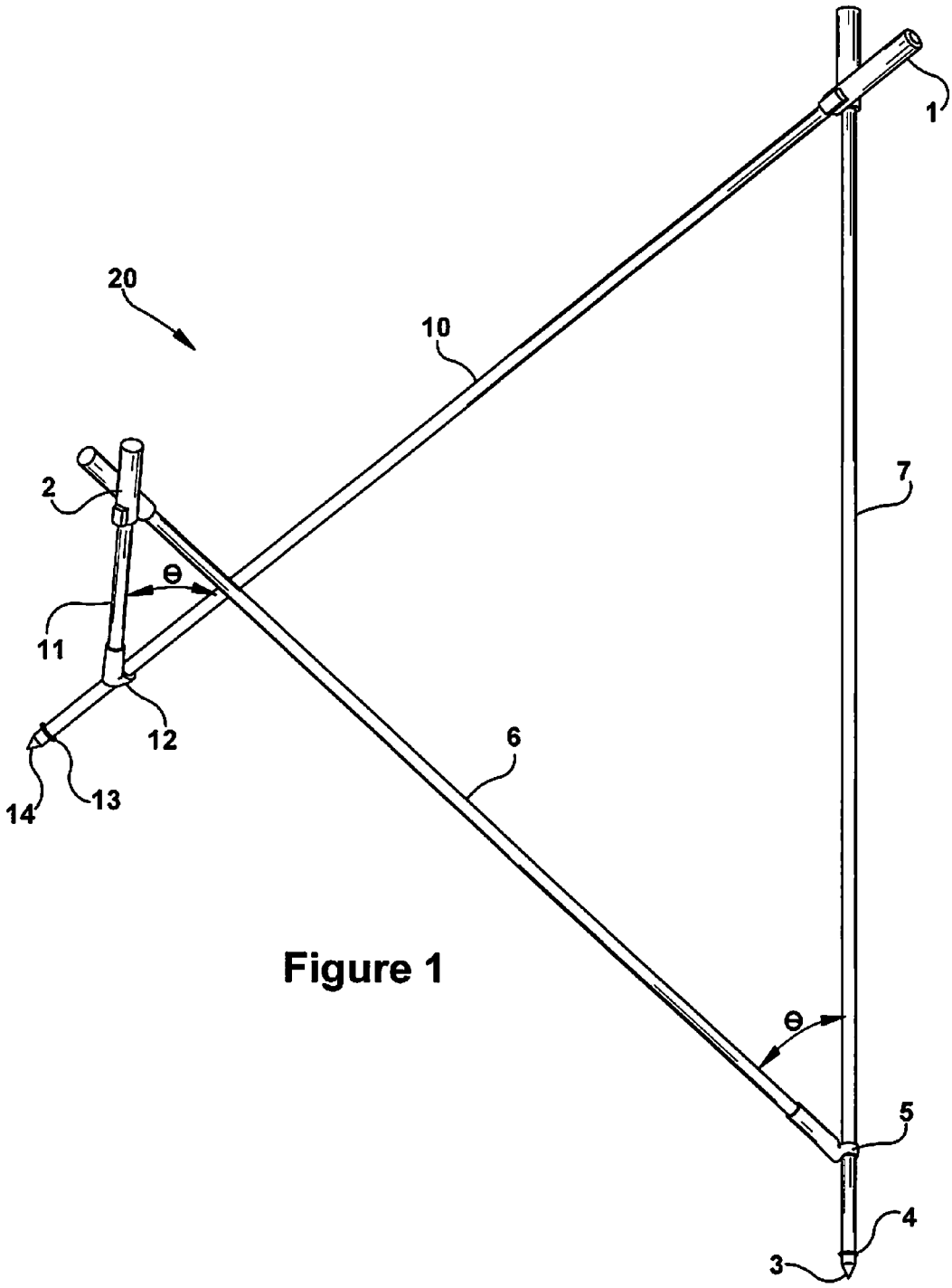
FIG. 1 illustrates an example of a perspective view of portable support mount.

The following presents a simplified overview of the example embodiments in order to provide a basic understanding of some aspects of the example embodiments. This overview is not an extensive overview of the example embodiments. It is intended to neither identify key or critical elements of the example embodiments nor delineate the scope of the appended claims. Its sole purpose is to present some concepts of the example embodiments in a simplified form as a prelude to the more detailed description that is presented later.

In accordance with an example embodiment, there is disclosed herein, an apparatus comprising a first pair of poles that intersect to form a first rest while in a first configuration and a second pair of poles having first ends coupled with the first pair of poles. The opposite ends of the second pair of poles intersect to form a second rest in the first configuration.

DESCRIPTION OF EXAMPLE EMBODIMENTS

This description provides examples not intended to limit the scope of the appended claims. The figures generally indicate the features of the examples, where it is understood and appreciated that like reference numerals are used to refer to like elements. Reference in the specification to "one embodiment" or "an embodiment" or "an example embodiment" means that a particular feature, structure, or characteristic described is included in at least one embodiment described herein and does not imply that the feature, structure, or characteristic is present in all embodiments described herein.

FIG. 1 illustrates an example of a perspective view of a portable support mount 20 suitable for a firearm rest. The portable support mount 20 comprises a first pair of poles 7, 10 intersecting to form a first rest 1 while in a first configuration. The portable support mounds further comprises a second pair of poles 6, 11 having first ends coupled with the first pair of poles 7, 10. The opposite ends (opposite of the first ends) of the second pair of poles 7, 10 intersect to form a second rest 2 in the first configuration.

In particular embodiments, the poles 6, 7, 10, 11 are constructed with aluminum. The ends of poles 6, 7, 1, 11 intersecting the first and second rests 1, 2 are comprises of flexible neoprene.

In an example embodiment, the first ends of the second pair of poles 6, 11 are coupled with the first pair of poles 7, 10 via guide/binders 5, 12. In particular embodiments, the (first) ends of the second pair of poles 6, 11 are operable to slide along the first pair of poles 7, 10 while the angle $\ominus$ between the first and second pair of legs is less than a predefined angle. For example, the second pair of poles 6, 11 may slide along the first pair of poles 7, 10 while the angle ($\ominus$) between them is less than 90 degrees. When the predetermined angle is reached, the guide/binders 5, 12 become bound and are unable to move.

In an example embodiment, the portable support mount 20 can be employed as a firearm rest. The first pair of poles 7, 10 are employed as a plurality of interconnected members forming first and second fore legs. The fore legs intersecting to form a first (or forward) firearm rest, 1. The fore legs further comprising ground contact points located at a first ends 3, 14 of the fore legs (poles 7, 10). The second pair of poles 6, 11 are employed as a second plurality of interconnecting members forming first and second aft legs. The aft legs intersecting to form an second (or aft) firearm rest 2. The second plurality of interconnecting members further comprising terminal ends coupling the first and second aft legs to the first and second fore legs respectively.

In an example embodiment, the first terminal of the aft legs are operable to slide along the fore legs while the angle between the first and second pair of legs is less than a predefined angle. For example, the first terminal of the aft legs may slide along the fore legs while the angle between the first and second pair of legs is less than ninety (90) degrees.

In an example embodiment, the fore legs 7, 10 further comprising guide/binder stops 4, 13. The guide/binder stops 4, 13 may be made of a flexible rubber like material such as neoprene and surmounted on to the fore legs. A pair of binder/guides 5, 12 can be employed to couple the aft legs 6, 11 with the fore legs 7, 10. When the fore legs 7, 10 and aft legs 6, 11 are substantially parallel or the angle between them is less than a predefined angle, the binder/guides 5,12 slide along the fore legs 7, 10. When the angle between the fore legs 7, 10 and aft legs 6, 11 is equal to or greater than the predefined angle, the holes in binder/guides 5, 12 deform and grip the fore legs 7, 10 (see e.g., FIGS. 1 and 3). The guide binder stops 4, 13 are located near the terminal ends of the fore legs.

Figure 2:
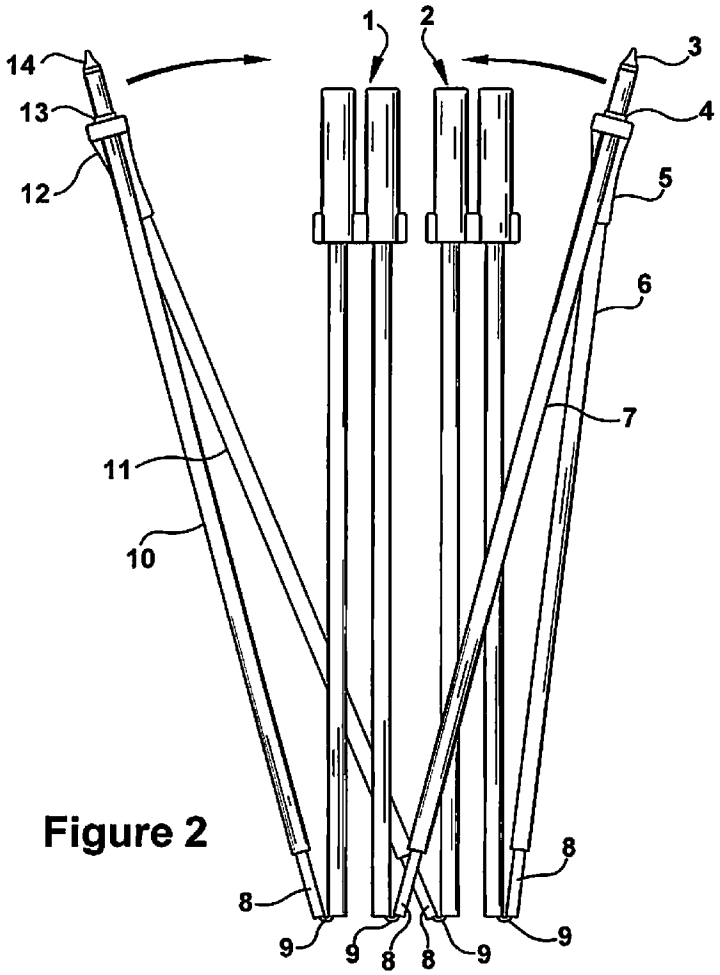
FIG. 2 illustrates an example of the portable support mount in a collapsed configuration.

FIG. 2 illustrates an example of the portable support mount 20 collapsed, or in a second configuration. This configuration can be useful for carrying or storing the portable support mount 20. In this configuration, The poles (or legs) 6, 7, 10, 111 suitably comprise inserts 8. In the illustrated embodiment, the inserts 8 can be slide allowing the poles 6, 7, 10, 11 to be disassembled. A shock cord 9 can be employed for holding the poles (legs) 6, 7, 10, 11 together while disassembled (e.g., in the second configuration).

As those skilled in the art can readily appreciate, the portable support mount 20 may suitably comprise multiple secondary rests mounted on the primary legs 10, 11. This would allow the portable mount 20 to additional rests for engaging a device at additional locations.

Figure 3:
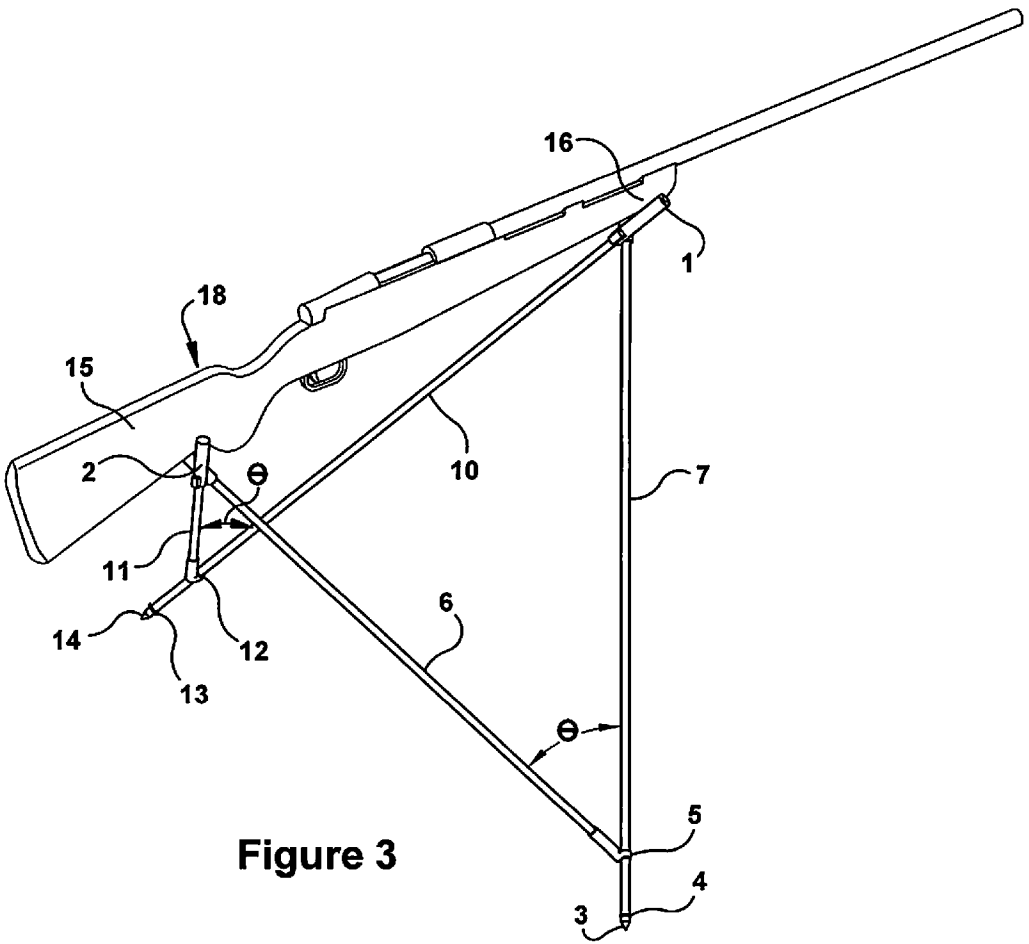
FIG. 3 illustrates an example of a perspective view of the portable support mount in an open and assembled configuration and engaged with a firearm.

FIG. 3 illustrates an example of a perspective view of the support mount 20 employed as a firearm rest in an open and assembled configuration while engaged with a firearm (a rifle in this example, although those skilled in the art should readily appreciate that this configuration is suitable for uses with other firearms such as shotguns) 15. The first (fore) rest engages a fore end 16 of the firearm 15 while the second (aft) rest engages an aft end 18 of the firearm 15.

Figure 4:
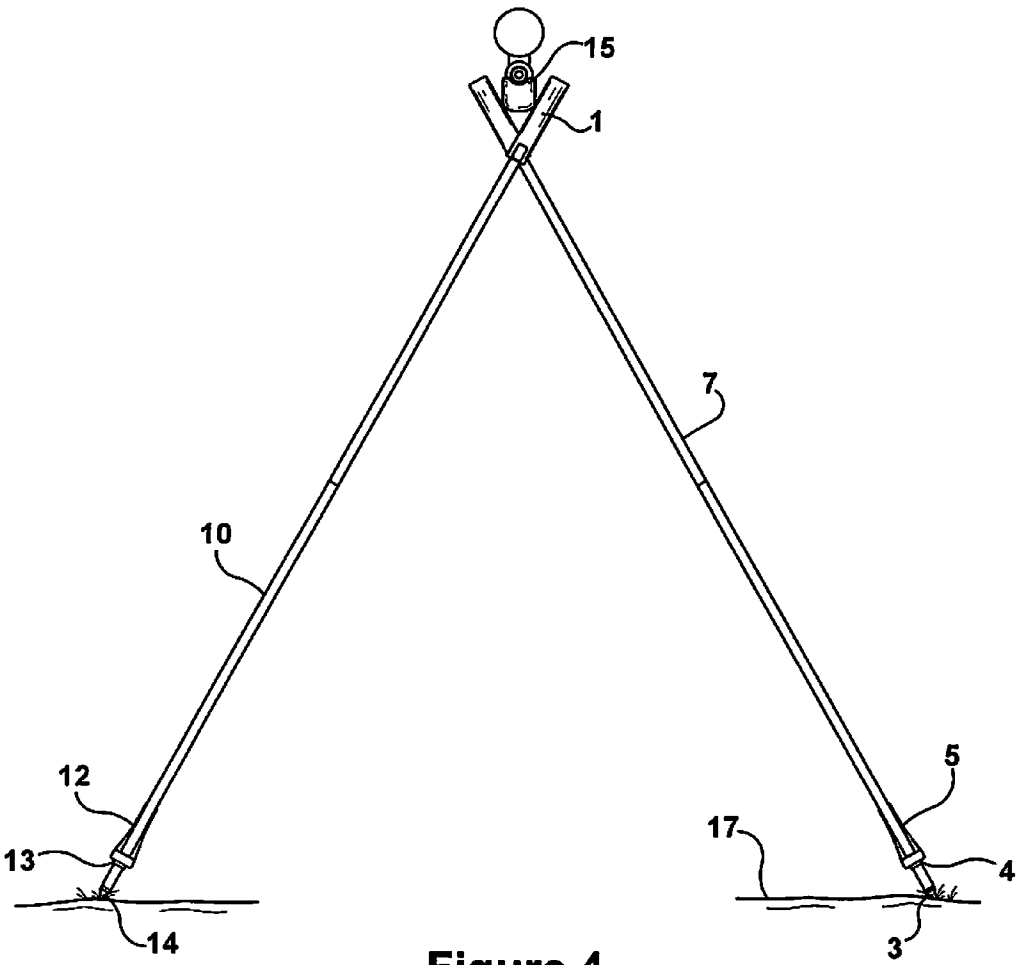
FIG. 4 illustrates a front view of the portable support mount engaged with a firearm.

FIG. 4 illustrates a front view of the portable support mount 20 while engaged with a firearm 15. In the illustrated example, the pole ends 3, 14 are in contact with a mounting surface 17 (e.g., ground, or any other suitable surface that ends 3, 14 can rest on, such as a rail in a tree stand). Binder/guide stops 3, 14 stop the binder/guides 5, 12 from sliding off of the first set of poles (fore legs) 7, 10.

Figure 5:
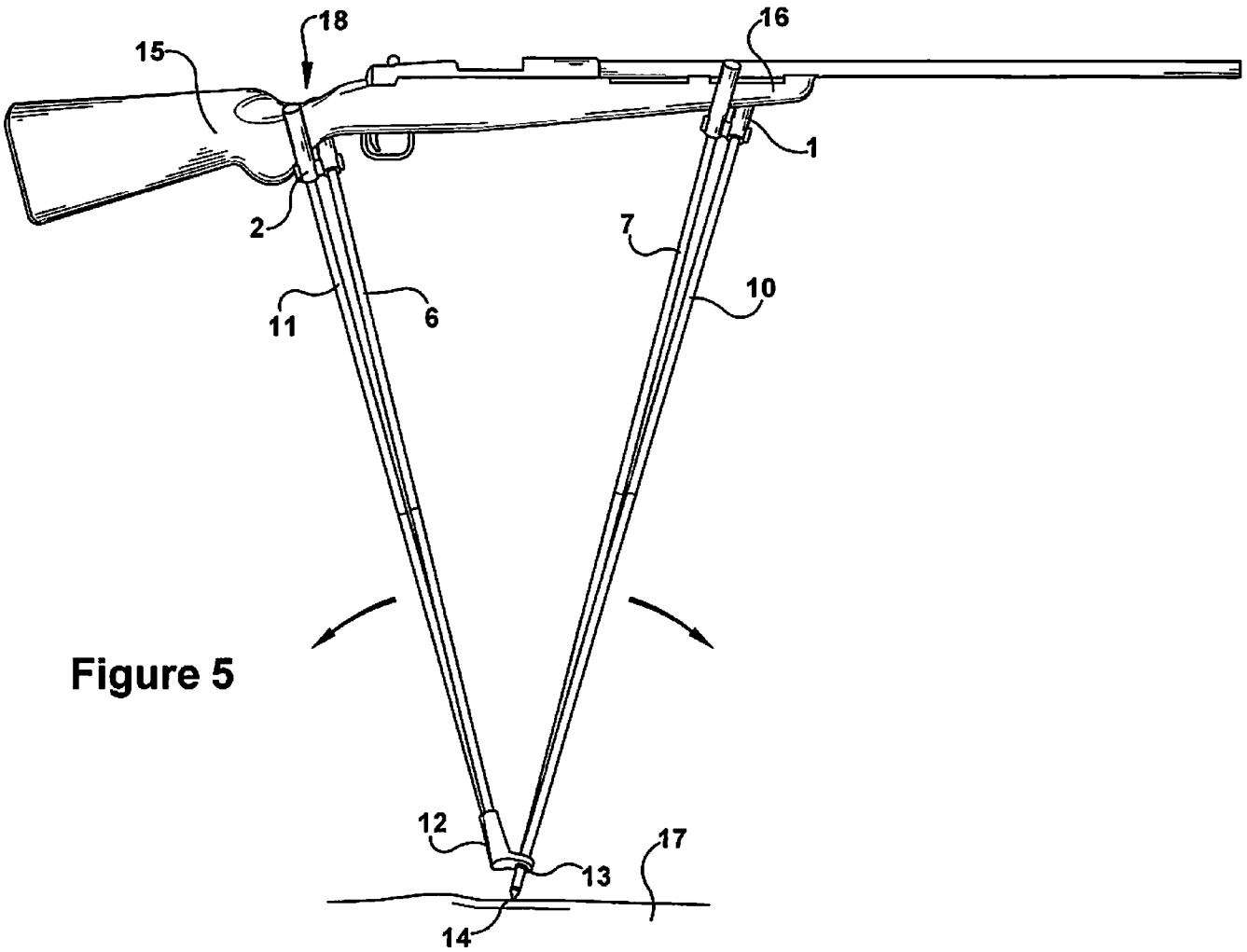
FIG. 5 illustrates a side view of the portable support mount engaged with a firearm

FIG. 5 illustrates a side view of the portable support mount 20 engaged with a firearm 15. The figure illustrates the first (fore) and second (aft) rests 1, 2 engaging the fore end 16 and the aft end 18 of the firearm 15.

Described above are example embodiments. It is, of course, not possible to describe every conceivable combination of components or methodologies, but one of ordinary skill in the art will recognize that many further combinations and permutations of the example embodiments are possible. Accordingly, this application is intended to embrace all such alterations, modifications and variations that fall within the spirit and scope of the appended claims interpreted in accordance with the breadth to which they are fairly, legally and equitably entitled.

The invention claimed is:

1. An apparatus, comprising:

a first pair of poles intersecting to form a first rest while in a first configuration; and a second pair of poles having first ends and second ends;

wherein the second ends of the second pair of poles intersect to form a second rest in the first configuration; and guide/binders coupling the second pair of poles to the first pair of poles;

wherein the first ends of the second pair of poles are inserted into a first part of the guide/binders that have an inner bottom;

wherein a second part of the guide/binders at least partially encircle the first set of poles;

wherein the guide/binders slide along the first pair of poles while an angle between the first pair of poles and the second pair of poles is less than a predetermined angle;

wherein upon reaching the predefined angle, the guide/binders become bound to the first set of poles and are unable to move along the first set of poles.

2. The apparatus of claim 1, wherein the predefined angle is ninety degrees.

3. The apparatus of claim 1, further comprising guide/binder stops attached to the first pair of poles.

4. The apparatus of claim 3, wherein the guide/binder stops are located at a first end of the poles, wherein the first end of the poles are opposite the first rest formed by the first pair of poles.

5. The apparatus of claim 1, wherein the first pair of poles and second pair of poles further comprise inserts that allow the first and second pair of poles to be disassembled into a second configuration.

6. The apparatus of claim 5, wherein the first pair of poles and second pair of poles further comprises a shock cord to hold the poles together while in the second configuration.

7. A firearm rest, comprising:

a plurality of interconnected members forming first and second fore legs, the fore legs intersecting to form a forward firearm rest, the fore legs further comprising ground contact points located at a first ends of the fore legs;

a second plurality of interconnecting members forming first and second aft legs, the aft legs intersecting to form an aft firearm rest, and having terminal ends opposite the aft firearm rest; and a pair of binder/guides that couple the terminal ends of the aft legs with the fore legs;

wherein the terminal ends of the aft legs are inserted into a first part of the guide/hinders that have an inner bottom;

wherein a second part of the guide/binders at least partially encircle the fore legs;

wherein the binder/guides are operable to slide along the fore legs while an angle between the fore legs and aft legs is less than a predetermined angle wherein upon reaching the predefined angle, the guide/binders become bound to the fore legs and are unable to move along the fore lees.

8. The firearm rest of claim 7, wherein the predefined angle is ninety degrees.

9. The firearm rest of claim 7, the fore legs further comprising guide/binder stops.

10. The firearm rest of claim 9, wherein the guide binder stops are located near the first ends of the fore legs.

11. The firearm rest of claim 7, wherein the fore legs and second aft legs further comprise inserts that allow the fore legs and aft legs to be disassembled.

12. The firearm rest of claim 11, wherein the fore legs and aft legs further comprise a shock cord to hold the poles together while disassembled.

* * * * *